US011798459B2

(12) United States Patent
Lee et al.

(10) Patent No.: US 11,798,459 B2
(45) Date of Patent: Oct. 24, 2023

(54) DISPLAY APPARATUS AND METHOD OF DRIVING A PLURALITY OF PIXELS IN THE DISPLAY APPARATUS

(71) Applicant: Samsung Display Co., Ltd., Yongin-si (KR)

(72) Inventors: Chang-Soo Lee, Suwon-si (KR); Joosun Yoon, Seoul (KR); Boyong Chung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/955,198

(22) Filed: Sep. 28, 2022

(65) Prior Publication Data

US 2023/0101274 A1 Mar. 30, 2023

(30) Foreign Application Priority Data

Sep. 28, 2021 (KR) ..... 10-2021-0127764

(51) Int. Cl.
*G09G 3/20* (2006.01)
*G09G 3/32* (2016.01)

(52) U.S. Cl.
CPC ..... *G09G 3/2096* (2013.01); *G09G 3/2007* (2013.01); *G09G 3/32* (2013.01); *G09G 2300/0819* (2013.01); *G09G 2310/08* (2013.01); *G09G 2320/0233* (2013.01)

(58) Field of Classification Search
CPC ..... G09G 3/2096; G09G 3/2007; G09G 3/32; G09G 2300/0819; G09G 2310/08; G09G 2320/0233
See application file for complete search history.

(56) References Cited

U.S. PATENT DOCUMENTS 9,711,092 B2 * 7/2017 Kishi ..... G09G 3/3291
2008/0036708 A1 * 2/2008 Shirasaki ..... G09G 3/3291 345/76
2008/0111812 A1 * 5/2008 Shirasaki ..... G09G 3/3291 345/212

(Continued)

FOREIGN PATENT DOCUMENTS

KR 10-1493226 2/2015
KR 2015-0079308 7/2015

(Continued)

*Primary Examiner* — David Tung

(74) *Attorney, Agent, or Firm* — H.C. Park & Associates, PLC

(57) ABSTRACT

A display apparatus includes a display panel including a plurality of pixels, a data driver to provide data voltages to the plurality of pixels and to sense threshold voltages of the pixels, and a driving controller to generate first difference values by calculating differences between the data voltages for first pixels included in an N-th pixel row and the data voltages for second pixels included in an (N+1)-th pixel row among the plurality of pixels in an initial driving period, to calculate limit offset values for the second pixels based on the first difference values, to generate threshold voltage compensation values for the second pixels based on the threshold voltages of the second pixels, and to compensate input image data for the second pixels based on the threshold voltage compensation values and the limit offset values, where N is an integer greater than 0.

23 Claims, 7 Drawing Sheets

(56) References Cited

U.S. PATENT DOCUMENTS

| | | | | |
|---|---|---|---|---|
| 2008/0246785 | A1* | 10/2008 | Shirasaki | G09G 3/3233 345/212 |
| 2009/0135111 | A1* | 5/2009 | Yamamoto | H10K 59/126 345/76 |
| 2009/0219231 | A1* | 9/2009 | Yamamoto | G09G 3/3233 345/76 |
| 2009/0322734 | A1* | 12/2009 | Yamamoto | G09G 3/3233 345/214 |
| 2013/0162617 | A1 | 6/2013 | Yoon et al. | |
| 2020/0043420 | A1* | 2/2020 | Kang | G09G 3/3291 |
| 2021/0118352 | A1* | 4/2021 | Baek | G09G 3/2007 |

FOREIGN PATENT DOCUMENTS

| | | |
|---|---|---|
| KR | 2016-0043326 | 4/2016 |
| KR | 2018-0011557 | 2/2018 |
| KR | 2018-0013263 | 2/2018 |

* cited by examiner

FIG. 7

| D1 | | | P21 | P22 | P23 | P24 |
|---|---|---|---|---|---|---|
| | | VDATA | 2+0 | 2+0.1 | 2+0.1 | 2+0.1 |
| | VDATA | | | | | |
| P11 | 2+0 | | 0 | | | |
| P12 | 2+0 | | | 0.1 | | |
| P13 | 2-0.1 | | | | 0.2 | |
| P14 | 2+0 | | | | | 0.1 |

MD1

FIG. 8

| D2 | | | MP P21 | P22 | P23 | MP P24 |
|---|---|---|---|---|---|---|
| | | TC | 0.4 | 0.3 | 0.4 | 0.5 |
| | TC | | | | | |
| P11 | 0.1 | | 0.3 | | | |
| P12 | 0.1 | | | 0.2 | | |
| P13 | 0.3 | | | | 0.1 | |
| P14 | -0.1 | | | | | 0.6 |

MD1:0.2

FIG. 9

| VDATA | | | P21 | P22 | P23 | P24 |
|---|---|---|---|---|---|---|
| | | TC | 0.4 | 0.3 | 0.4 | 0.5 |
| | L0 | | | | | |
| P21 | 0.1 | | 2+0.3 | | | |
| P22 | 0 | | | 2+0.3 | | |
| P23 | −0.1 | | | | 2+0.4 | |
| P24 | 0.4 | | | | | 2+0.1 |

MD1:0.2

D3

FIG. 10

| D1 | | | P21 | P22 | P23 | P24 |
|---|---|---|---|---|---|---|
| | | VDATA | 2+0 | 2+0.1 | 2+0.1 | 2+0.1 |
| | VDATA | | | | | |
| P11 | 2+0 | | 0 | | | |
| P12 | 2+0 | | | 0.1 | | |
| P13 | 2−0.1 | | | | 0.2 | |
| P14 | 2+0 | | | | | 0.1 |

MD1

FIG. 11

MP

| | | | P21 | P22 | P23 | P24 | ATC |
|---|---|---|---|---|---|---|---|
| | | TC | 0.4 | 0.3 | 0.4 | 0.5 | 0.4 |
| | TC | | | | | | |
| P11 | 0.1 | | 0.3 | | | | |
| P12 | 0.1 | | | 0.2 | | | |
| P13 | 0.3 | | | | 0.1 | | |
| P14 | -0.1 | | | | | 0.6 | |
| ATC | 0.1 | | | | | | 0.3 |

MD1:0.2

D4

FIG. 12

| VDATA | | | P21 | P22 | P23 | P24 |
|---|---|---|---|---|---|---|
| | | TC | 0.4 | 0.3 | 0.4 | 0.5 |
| | L0 | | | | | |
| P21 | 0.1 | | 2+0.3 | | | |
| P22 | 0.1 | | | 2+0.2 | | |
| P23 | 0.1 | | | | 2+0.3 | |
| P24 | 0.1 | | | | | 2+0.4 |

MD1:0.2

D5

DISPLAY APPARATUS AND METHOD OF DRIVING A PLURALITY OF PIXELS IN THE DISPLAY APPARATUS

CROSS REFERENCE TO RELATED APPLICATION

This application claims priority from and the benefit of Korean Patent Application No. 10-2021-0127764, filed on Sep. 28, 2021, which is hereby incorporated by reference for all purposes as if fully set forth herein.

BACKGROUND

Field

Embodiments of the invention relate to a display apparatus, and more particularly, to a display apparatus capable of sensing a threshold voltage of a driving transistor to compensate input image data.

Discussion of the Background

Generally, a display apparatus may include a display panel, a driving controller, gate driver, and a data driver. The display panel may include a plurality of gate lines, a plurality of data lines, and a plurality of pixels electrically connected to the gate lines and the data lines. The gate driver may provide gate signals to the gate lines. The data driver may provide data voltages to the data lines. The driving controller may control the gate driver and the data driver.

A conventional display apparatus may compensate for a deviation in the threshold voltages of respective pixels by sensing the threshold voltages of driving transistors included in the pixels. However, when the threshold voltage is sensed, a compensation error may be caused by a fluctuation of a power supply voltage, an electrostatic discharge (ESD) voltage, or the like.

The above information disclosed in this Background section is only for understanding of the background of the inventive concepts, and, therefore, it may contain information that does not constitute prior art.

SUMMARY

Display apparatuses constructed according to the principles and illustrative embodiments of the invention are capable of compensating input image data based on limit offset values calculated based on differences of data voltages calculated in an initial driving period.

Therefore, such display apparatus may remove a mura displayed on an image in an initial driving period by performing a mura compensation in the initial driving period.

In addition, the display apparatus may remove a mura displayed on an image after an initial driving period by preventing differences of data voltages between adjacent pixel rows after the initial driving period from exceeding a maximum value of differences of data voltages between the adjacent pixel rows in the initial driving period.

Further, the display apparatus may remove a mura displayed on an image after an initial driving period by preventing an average of differences of data voltages between adjacent pixel rows after the initial driving period from exceeding a maximum value of differences of data voltages between the adjacent pixel rows in the initial driving period.

Additional features of the inventive concepts will be set forth in the description which follows, and in part will be apparent from the description, or may be learned by practice of the inventive concepts.

According to one aspect of the invention, a display apparatus includes a display panel including a plurality of pixels, a data driver to provide data voltages to the plurality of pixels and to sense threshold voltages of the pixels, and a driving controller to generate first difference values by calculating differences between the data voltages for first pixels included in an N-th pixel row and the data voltages for second pixels included in an (N+1)-th pixel row among the plurality of pixels in an initial driving period, to calculate limit offset values for the second pixels based on the first difference values, to generate threshold voltage compensation values for the second pixels based on the threshold voltages of the second pixels, and to compensate input image data for the second pixels based on the threshold voltage compensation values and the limit offset values, where N is an integer greater than 0.

Each of the first difference values may be a difference of the data voltages for displaying the same grayscale level between a corresponding one of the first pixels and a corresponding one of the second pixels electrically connected to the same data line.

In the initial driving period, the driving controller may generate mura compensation values of the plurality of pixels and compensate the input image data based on the mura compensation values and the threshold voltage compensation values.

In the initial driving period, the driving controller may capture an image displayed on the display panel and generate the mura compensation values based on the captured image.

The driving controller may determine a first maximum difference value among the first difference values, and calculate the limit offset values based on the first maximum difference value.

The driving controller may generate second difference values by calculating differences between the threshold voltage compensation values for the first pixels and the threshold voltage compensation values for the second pixels, and calculate the limit offset values based on the second difference values and the first maximum difference value.

Each of the second difference values may be a difference of the threshold voltage compensation values between a corresponding one of the first pixels and a corresponding one of the second pixels electrically connected to the same data line.

The driving controller may calculate the limit offset values by calculating differences between the second difference values and the first maximum difference value.

The driving controller may identify the second pixels corresponding to the second difference values greater than the first maximum difference value as erroneous compensation pixels, calculate third difference values by calculating differences between the threshold voltage compensation values of the erroneous compensation pixels and the limit offset values of the erroneous compensation pixels, and compensate the input image data for the erroneous compensation pixels based on the third difference values.

The data driver may sense the threshold voltages of the pixels in a power-off period.

Each of the pixels includes a first switching element including a control electrode electrically connected to a first node, an input electrode to receive a first power voltage, and an output electrode electrically connected to a second node, a second switching element including a control electrode to receive a first signal, an input electrode to receive a corresponding data voltage, and an output electrode electrically connected to the first node, a light emitting element including a first electrode electrically connected to the second node and a second electrode electrically to receive a second power voltage, and a third switching element including a control electrode to receive a second signal, an input electrode electrically connected to the second node, and an output electrode electrically connected to a third node.

According to another aspect of the invention, a display apparatus includes a display panel including a plurality of pixels, a data driver to provide data voltages to the plurality of pixels and to sense threshold voltages of the plurality of pixels, and a driving controller to generate first difference values by calculating differences between the data voltages for first pixels included in an N-th pixel row and second pixels included in an (N+1)-th pixel row among the plurality of pixels in an initial driving period, to calculate a limit offset value for the second pixels based on the first difference values, an average threshold voltage compensation value for the first pixels, and an average threshold voltage compensation value for the second pixels, to generate threshold voltage compensation values for the second pixels based on the threshold voltages of the second pixels, and to compensate the input image data for the second pixels based on the threshold voltage compensation values and the limit offset value, where N is an integer greater than 0.

Each of the first difference values may be a difference of the data voltages for displaying the same grayscale level between a corresponding one of the first pixels and a corresponding one of the second pixels electrically connected to the same data line.

In the initial driving period, the driving controller may generate mura compensation values of the plurality of pixels and compensate the input image data based on the mura compensation values and the threshold voltage compensation values.

In the initial driving period, the driving controller may capture an image displayed on the display panel and generate the mura compensation values based on the captured image.

The driving controller may determine a first maximum difference value among the first difference values, and calculate the limit offset value based on the first maximum difference value.

The driving controller may generate fourth difference value by calculating a difference between the average threshold voltage compensation value for the first pixels and the average threshold voltage compensation value for the second pixels, and calculate the limit offset value based on the fourth difference value and the first maximum difference value.

The driving controller may calculate the limit offset value by calculating a difference between the fourth difference value and the first maximum difference value.

The driving controller may identify the second pixels as erroneous compensation pixels when the fourth difference value is greater than the first maximum difference value, calculate fifth difference values by calculating differences between the threshold voltage compensation values for the erroneous compensation pixels and the limit offset value, and compensate the input image data for the erroneous compensation pixels based on the fifth difference values.

The data driver may be configured to sense the threshold voltages in a power-off period.

According to another aspect of the invention, a method of driving a plurality of pixels in a display apparatus includes: generating data voltages to sense threshold voltages of the pixels; generating first difference values by calculating differences between the data voltages for first pixels included in an N-th pixel row and the data voltages for second pixels included in an (N+1)-th pixel row among the plurality of pixels in an initial driving period; calculating limit offset values for the second pixels based on the first difference values, generating threshold voltage compensation values for the second pixels based on the threshold voltages of the second pixels; and compensating the input image data for the second pixels based on the threshold voltage compensation values and the limit offset values, where N is an integer greater than 0.

The method may further include: generating mura compensation values of the plurality of pixels; and compensating the input image data based on the mura compensation values and the threshold voltage compensation values.

The method may further include: capturing an image displayed on the display panel in the initial driving period, and generating the mura compensation values based on the captured image.

It is to be understood that both the foregoing general description and the following detailed description are illustrative and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate illustrative embodiments of the invention, and together with the description serve to explain the inventive concepts.

FIGS. 7, 8, and 9 are tables describing an example in which the display apparatus of FIG. 1 compensates input image data for second pixels.

FIGS. 10, 11, and 12 are tables describing an example in which the display apparatus of FIG. 1 compensates input image data for second pixels.

DETAILED DESCRIPTION

Figure 1:
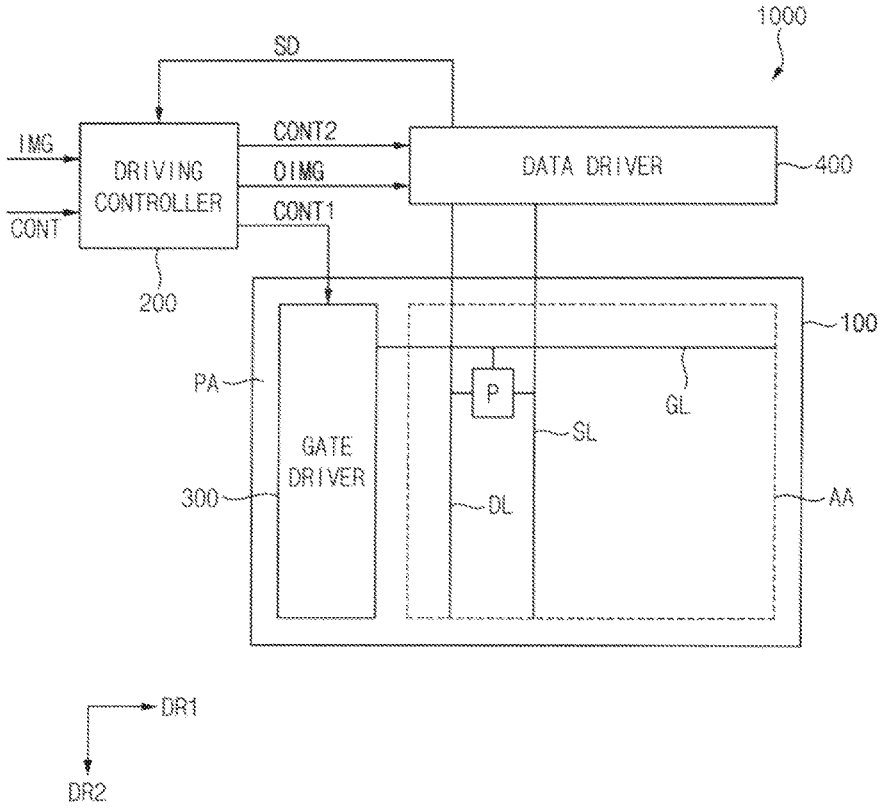
FIG. 1 is a block diagram illustrating an embodiment of a display apparatus constructed according to the principles of the invention.

In the following description, for the purposes of explanation, numerous specific details are set forth in order to provide a thorough understanding of various embodiments or implementations of the invention. As used herein "embodiments" and "implementations" are interchangeable words that are non-limiting examples of devices or methods employing one or more of the inventive concepts disclosed herein. It is apparent, however, that various embodiments may be practiced without these specific details or with one or more equivalent arrangements. In other instances, well-known structures and devices are shown in block diagram form in order to avoid unnecessarily obscuring various embodiments. Further, various embodiments may be different, but do not have to be exclusive. For example, specific shapes, configurations, and characteristics of an embodiment may be used or implemented in another embodiment without departing from the inventive concepts.

Unless otherwise specified, the illustrated embodiments are to be understood as providing illustrative features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the DR1-axis, the DR2-axis, and the DR3-axis are not limited to three axes of a rectangular coordinate system, such as the x, y, and z-axes, and may be interpreted in a broader sense. For example, the DR1-axis, the DR2-axis, and the DR3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the scope of the inventive concepts. Further, the blocks, units, and/or modules of some embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Hereinafter, embodiments will be explained in detail with reference to the accompanying drawings.

FIG. 1 is a block diagram illustrating an embodiment of a display apparatus 1000 constructed according to the principles of the invention.

Referring to FIG. 1, the display apparatus 1000 may include a display panel 100, a driving controller 200, a gate driver 300, and a data driver 400. According to an embodiment, the driving controller 200 and the data driver 400 may be integrated into one chip.

The display panel 100 has a display region AA on which an image is displayed and a peripheral region PA adjacent to the display region AA. According to an embodiment, the gate driver 300 may be integrated on the peripheral region PA of the display panel 100.

The display panel 100 may include a plurality of gate lines GL, a plurality of data lines DL, a plurality of sensing lines SL, and a plurality of pixels P electrically connected to the data lines DL, the gate lines GL, and the sensing lines SL. The gate lines GL may extend in a first direction DR1 and the data lines DL and the sensing lines SL may extend in a second direction DR2 crossing the first direction DR1.

The driving controller 200 may receive input image data IMG and an input control signal CONT from a host processor (e.g., a graphic processing unit; GPU). For example, the input image data IMG may include red image data, green image data and blue image data. According to an embodiment, the input image data IMG may further include white image data. For another example, the input image data IMG may include magenta image data, yellow image data, and cyan image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, and an output image data OIMG based on the input image data IMG, the input control signal CONT, and a sensing data SD.

The driving controller 200 may generate the first control signal CONT1 for controlling operation of the gate driver 300 based on the input control signal CONT and output the first control signal CONT1 to the gate driver 300. The first control signal CONT1 may include a vertical start signal and a gate clock signal.

The driving controller 200 may generate the second control signal CONT2 for controlling operation of the data driver 400 based on the input control signal CONT and output the second control signal CONT2 to the data driver 400. The second control signal CONT2 may include a horizontal start signal and a load signal.

The driving controller 200 may receive the input image data IMG, the input control signal CONT, and the sensing data SD, and generate the output image data OIMG. The driving controller 200 may output the output image data OIMG to the data driver 400.

The gate driver 300 may generate gate signals in response to the first control signal CONT1 input from the driving controller 200. The gate driver 300 may output the gate signals to the gate lines GL. For example, the gate driver 300 may sequentially output the gate signals to the gate lines GL.

The data driver 400 may receive the second control signal CONT2 and the output image data OIMG from the driving controller 200. The data driver 400 may convert the output image data OIMG into data voltages having an analog type. The data driver 400 may output the data voltages to the data lines DL. The data driver 400 may receive sensing voltages through the sensing lines SL. The data driver 400 may sense threshold voltages of the pixels P based on the sensing voltages. In an embodiment, the data driver 400 may sense the threshold voltages to generate the sensing data SD and output the sensing data SD to the driving controller 200.

Figure 2:
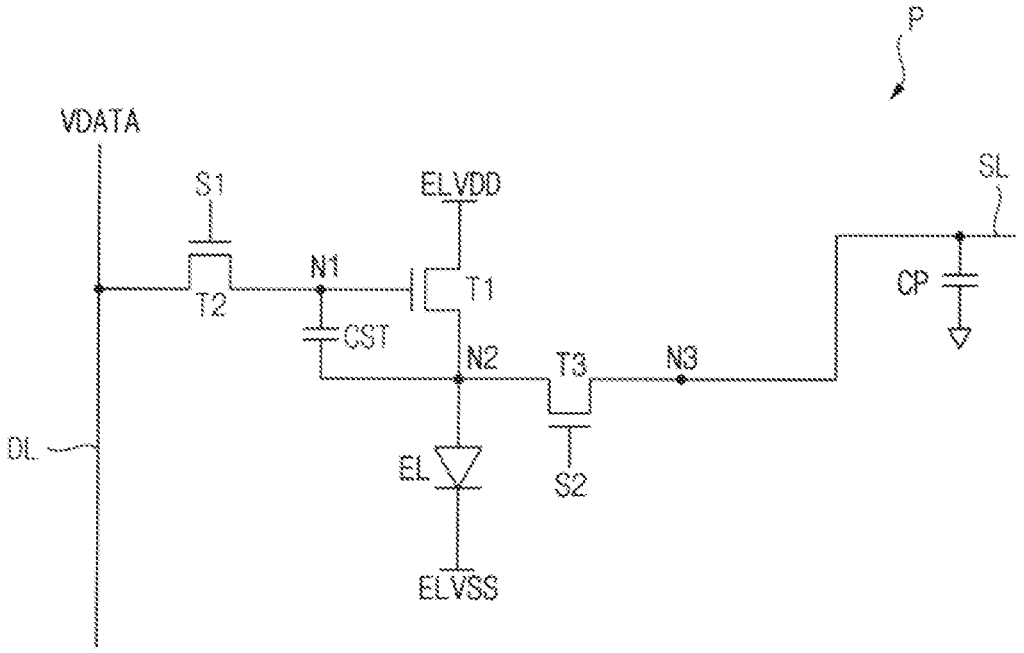
FIG. 2 is a circuit diagram illustrating an example of a representative pixel of the display apparatus of FIG. 1.
Figure 3:
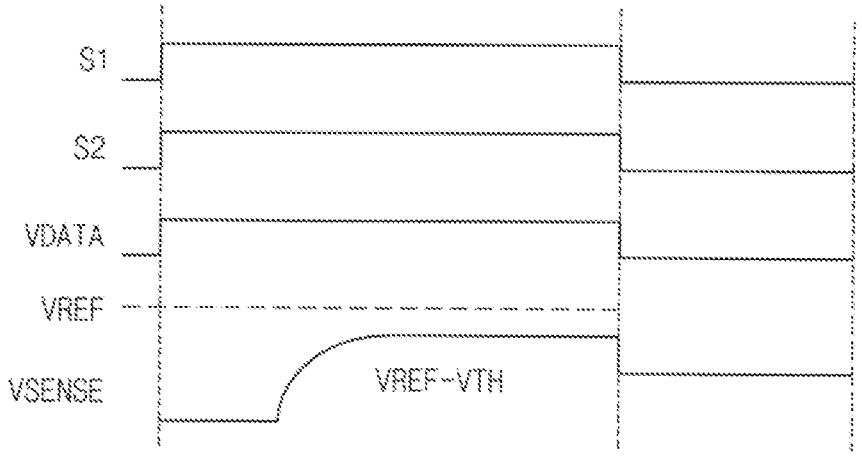
FIG. 3 is a timing diagram illustrating an example of I/O signals of pixels of the display apparatus of FIG. 1 in a power-off period.

FIG. 2 is a circuit diagram illustrating an example of a representative pixel P of the display apparatus 1000 of FIG. 1, and FIG. 3 is a timing diagram illustrating an example of I/O signals of the pixels P of the display apparatus 1000 of FIG. 1 in a power-off period.

Referring to FIGS. 1, 2, and 3, at least one of the pixels P of the display panel 100 may include a first switching element, which may be in the form of a first transistor T1, including a control electrode (e.g., a gate electrode) electrically connected to a first node N1, an input electrode configured to receive a first power voltage ELVDD, and an output electrode electrically connected to a second node N2, a second switching element, which may be in the form of a second transistor T2, including a control electrode (e.g., a gate electrode) configured to receive a first signal S1, an input electrode configured to receive the data voltage VDATA, and an output electrode electrically connected to the first node N1, a light emitting element EL including a first electrode electrically connected to the second node N2 and a second electrode configured to receive a second power voltage ELVSS, and a third switching element, which may be in the form of a third transistor T3, including a control electrode (e.g., a gate electrode) configured to receive a second signal S2, an input electrode electrically connected to the second node N2, and an output electrode electrically connected to the third node N3.

In an embodiment, each of the pixels P may further include a storage capacitor CST including a first electrode electrically connected to the first node N1 and a second electrode electrically connected to the second node N2. In addition, a parasitic capacitance of the display panel 100 is denoted by CP.

The data driver 400 may output the data voltages VDATA to the pixels P. Also, the data driver 400 may receive sensing voltages VSENSE from the pixels P.

The data driver 400 may receive the sensing voltages VSENSE from the pixels P in the power-off period. In the power-off period, the display apparatus 1000 may sense a threshold voltage Vth of the first transistor T1 (i.e., a driving transistor) to compensate a deviation of the threshold voltage of the driving transistor between the pixels P. The display apparatus 1000 may compensate the deviation of the threshold voltage Vth of the first transistor T1 by generating a threshold voltage compensation value based on the sensed threshold voltage Vth of the first transistor T1 and compensating the input image data IMG based on the threshold voltage compensation value.

In the power-off period, the first signal S1 and the second signal S2 may have an activated state (e.g., a turn-on voltage level). In the power-off period, a reference voltage VREF may be applied to the control electrode (e.g., the gate electrode) of the first transistor T1. For example, in the power-off period, the data voltage VDATA may be the reference voltage VREF.

In the power-off period, the first transistor T1 may operate as a source follower. The sensing voltage VSENSE may be changed to a value (VREF-Vth) obtained by subtracting the threshold voltage Vth of the first transistor T1 from the reference voltage VREF.

The display apparatus 1000 may detect the sensing voltage VSENSE. The display apparatus 1000 may determine the threshold voltage Vth of the first transistor T1 based on the sensing voltage VSENSE.

Figure 4:
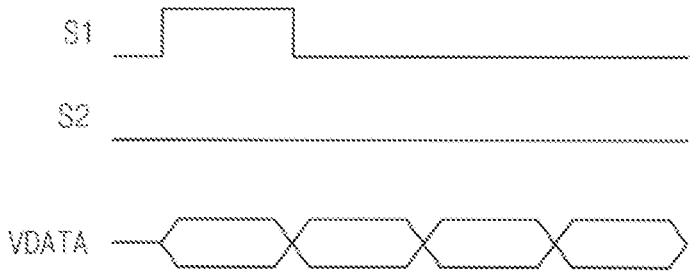
FIG. 4 is a timing diagram illustrating an example of I/O signals of pixels of the display apparatus of FIG. 1 in a power-on period.

FIG. 4 is a timing diagram illustrating an example of I/O signals of the pixels P of the display apparatus 1000 of FIG. 1 in a power-on period.

Referring to FIGS. 1 to 4, the driving controller 200 may sense the threshold voltage Vth of the first transistor T1 of the pixels P based on the sensing voltage VSENSE received from the sensing line SL, and generate the threshold voltage compensation value based on the threshold voltage Vth of the first transistor T1. The driving controller 200 may compensate the input image data IMG based on the threshold voltage compensation value to generate the output image data OIMG.

The driving controller 200 may output the output image data OIMG which the deviation of the threshold voltage Vth of the first transistor T1 is compensated to the data driver 400, the data driver 400 may convert the output image data OIMG to the data voltages VDATA, and the data driver 400 may output the data voltages VDATA to the pixels P.

In the power-on period, the first signal S1 may be a gate signal of the pixels P and may be scanned according to a driving timing of the pixels P.

In the power-on period, the data voltages VDATA may be the data voltages VDATA of the pixels P, and may have values corresponding to grayscale levels of the pixels P.

In the power-on period, the second signal S2 may have an inactive state (e.g., a turn-off voltage level). Since the third transistor T3 is turned off by the second signal S2 having the inactive state (e.g., the turn-off voltage level) in the power-on period, the third transistor T3 may not affect an operation of the pixels P.

Figure 5:
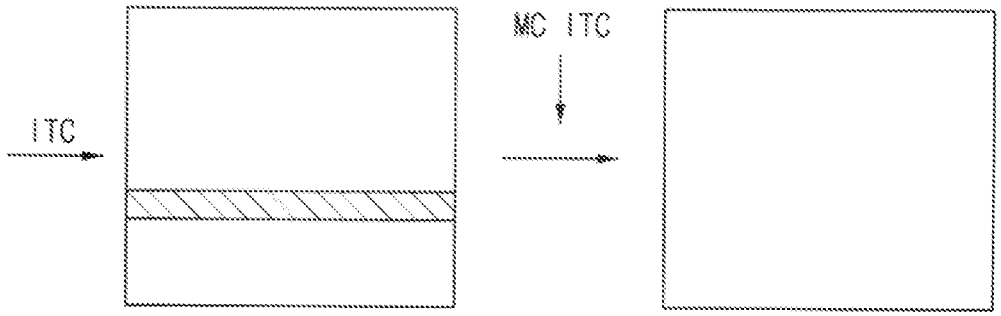
FIG. 5 is a diagram illustrating an example in which the display apparatus of FIG. 1 compensates input image data in an initial driving period.

FIG. 5 is a diagram illustrating an example in which the display apparatus 1000 of FIG. 1 compensates input image data IMG in an initial driving period.

Referring to FIG. 5, in the initial driving period, the driving controller 200 may generate mura compensation values MC of the pixels P and compensates the input image data IMG based on the mura compensation values MC and the initial threshold voltage compensation values ITC. In the initial driving period, the driving controller 200 may capture an image displayed on the display panel 100 (e.g., by mura detection tools such as an image sensor or a camera) and generates the mura compensation values MC based on the captured image. The initial driving period may be a first driving time after the display apparatus 1000 is manufactured. The initial driving period may be performed in the power-on period.

For example, in the initial driving period, the display apparatus 1000 may capture an image of the input image data IMG compensated based on only the initial threshold voltage compensation values ITC. The initial threshold voltage compensation values ITC may be threshold voltage compensation values generated in the power-off period immediately before the initial driving period. The image of the input image data IMG compensated based on only the initial threshold voltage compensation values ITC may include a mura phenomenon (e.g., luminance non-uniformity). The display apparatus 1000 may detect a location of the mura phenomenon (e.g., the luminance non-uniformity) and generate the mura compensation values MC for removing the mura phenomenon based on the captured image. In the initial driving period, the display apparatus 1000 may compensate the input image data IMG based on the initial threshold voltage compensation values ITC and the mura compensation values MC. In an embodiment, the driving controller 200 may compensate the input image data IMG so that the data voltages VDATA is increased by a sum of the initial threshold voltage compensation value ITC and the mura compensation value MC. For example, when the sum of the initial threshold voltage compensation value ITC of a specific pixel and the mura compensation value MC of the specific pixel is 0.1V and the grayscale voltage for displaying 255 grayscale level is 2V, the data voltage VDATA applied to the specific pixel to display 255 grayscale level may be 2.1V. Accordingly, the mura phenomenon may not appear in the image of the input image data IMG compensated based on the initial threshold voltage compensation values ITC and the mura compensation values MC. However, since it is necessary to capture an image, the mura compensation (i.e., compensation of the input image data IMG based on the mura compensation value MC) may be performed only in the initial driving period.

Figure 6:
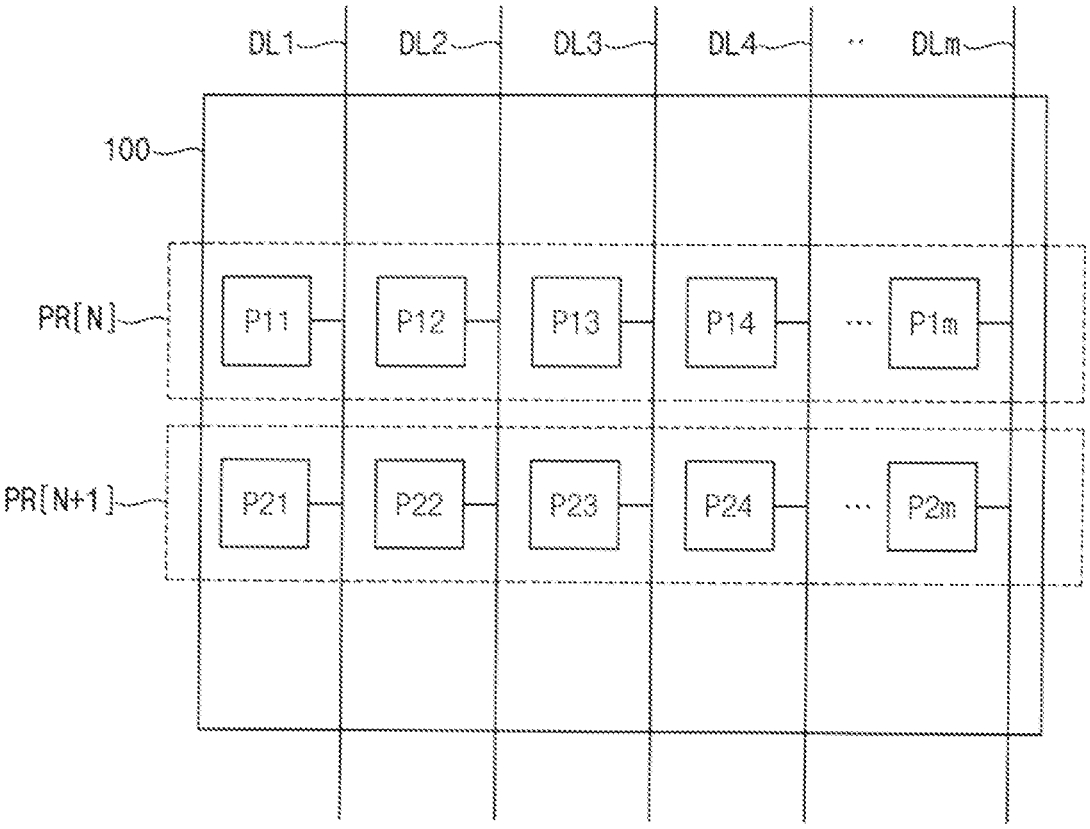
FIG. 6 is a diagram illustrating an example of a display panel of the display apparatus of FIG. 1.

FIG. 6 is a diagram illustrating an example of the display panel 100 of the display apparatus 1000 of FIG. 1 including first pixels P11, P12, P13, P14, . . . , P1*m* and second pixels P21, P22, P23, P24, . . . , P2*m* electrically connected to the data lines DL1, DL2, DL3, DL4, . . . , DLm, and FIGS. 7, 8, and 9 are tables for describing an example in which the display apparatus 1000 of FIG. 1 compensates the input image data IMG for the second pixels P21, P22, P23, and P24. For example, the first pixels P11, P12, P13, and P14 are referred to as a first-first pixel P11, a first-second pixel P12, a first-third pixel P13, and a first-fourth pixel P14. For example, the second pixels P21, P22, P23, and P24 are referred to as a second-first pixel P21, a second-second pixel P22, a second-third pixel P23, and a second-fourth pixel P24.

Referring to FIGS. 6, 7, 8, and 9, the driving controller 200 may generate first difference values D1 by calculating differences between the data voltages VDATA for the first pixels P11, P12, P13, and P14 included in an N-th pixel row PR[N], where N is an integer greater than 0, and the data voltages VDATA for the second pixels P21, P22, P23, and P24 included in an (N+1)-th pixel row PR[N+1] among the pixels P in the initial driving period, calculate limit offset values LO of the second pixels P21, P22, P23, and P24 based on the first difference values D1, generate threshold voltage compensation values TC of the second pixels P21, P22, P23, and P24 based on the threshold voltages of the second pixels P21, P22, P23, and P24, and compensate the input image data IMG for the second pixels P21, P22, P23, and P24 based on the threshold voltage compensation values TC and the limit offset values LO. Since N is an arbitrary positive integer, the driving controller 200 may compensate the input image data IMG for all the pixels P of the display panel 100.

In an embodiment for a first pixel row, in the initial driving period, the driving controller 200 may calculate differences of the data voltages VDATA between pixels included in the first pixel row and pixels included in a second pixel row to generate the first difference values D1. After the initial driving period, the driving controller 200 may calculate the limit offset values LO of the pixels included in the first pixel row based on the first difference values D1 for the first pixels row and the second pixel row, calculate the limit offset values LO of the pixels included in the first pixel row, generate the threshold voltage compensation values TC of the pixels included in the first pixel row are generated based on the threshold voltages of the pixels included in the first pixel row, and compensate the input image data for the pixels included in the first pixel row based on the threshold voltage compensation values TC and limit offset values LO.

Referring to FIGS. 5, 6, and 7, the driving controller 200 may generate the first difference values D1 by calculating the differences between the data voltages VDATA for the first pixels P11, P12, P13, and P14 included in the N-th pixel row PR[N] and the data voltages VDATA for the second pixels P21, P22, P23, and P24 included in the (N+1)-th pixel row PR[N+1] among the pixels P in the initial driving period. Each of the first difference values D1 may be a difference of the data voltages VDATA for displaying a same grayscale level between the first-first pixel P11 and the second-first pixel P21 electrically connected to a same data line (e.g., DL1), between the first-second pixel P12 and the second-second pixel P22 electrically connected to a same data line (e.g., DL2), between the first-third pixel P13 and the second-third pixel P23 electrically connected to a same data line (e.g., DL3), and between the first-fourth pixel P14 and the second-fourth pixel P24 electrically connected to a same data line (e.g., DL4). The driving controller 200 may determine a first maximum difference value MD1 among the first difference values D1. The first maximum difference value MD1 may be the greatest value among the first difference values D1. As mentioned above, the mura phenomenon may not appear in the image of the input image data IMG compensated based on the initial threshold voltage compensation values ITC and the mura compensation values MC. The mura phenomenon may be generated by a difference of luminance between adjacent pixels P. For example, when the differences of the data voltages VDATA between adjacent pixels (e.g., adjacent pixel rows) is less than the greatest value of the differences of the data voltages VDATA between adjacent pixels P (e.g., adjacent pixel rows) in the initial driving period (e.g., the first maximum difference value MD1), the mura phenomenon may not appear.

For example, it is assumed that the grayscale voltage for displaying 255 grayscale level is 2V, a sum of the initial threshold voltage compensation value ITC of the first-first pixel P11 and the mura compensation value MC of the first-first pixel P11 is 0, a sum of the initial threshold voltage compensation value ITC of the first-second pixel P12 and the mura compensation value MC of the first-second pixel P12 is 0, a sum of the initial threshold voltage compensation value ITC of the first-third pixel P13 and the mura compensation value MC of the first-third pixel P13 is −0.1, a sum of the initial threshold voltage compensation value ITC of the first-fourth pixel P14 and the mura compensation value MC of the first-fourth pixel P14 is 0, a sum of the initial threshold voltage compensation value ITC of the second-first pixel P21 and the mura compensation value MC of the second-first pixel P21 is 0, a sum of the initial threshold voltage compensation value ITC of the second-second pixel P22 and the mura compensation value MC of the second-second pixel P22 is 0.1, a sum of the initial threshold voltage compensation value ITC of the second-third pixel P23 and the mura compensation value MC of the second-third pixel P23 is 0.1, and a sum of the initial threshold voltage compensation value ITC of the second-fourth pixel P24 and the mura compensation value MC of the second-fourth pixel P24 is 0.1. In this case, the first difference values D1 may be 0 (i.e., 2−2=0), 0.1 (i.e., 2.1−2=0.1), 0.2 (i.e., 2.1−1.9=0.2), and 0.1 (i.e., 2.1−2=0.1). Since the greatest value among the first difference values D1 is 0.2, the first maximum difference value MD1 is 0.2.

Referring to FIGS. 5, 6, 7, and 8, after the initial driving period, the driving controller 200 may calculate the limit offset values LO of the second pixels P21, P22, P23, and P24 based on the first difference values D1. The driving controller 200 may calculate the limit offset values LO based on the first maximum difference value MD1. The driving controller 200 may generate second difference values D2 by calculating differences between the threshold voltage compensation values TC for the first pixels P11, P12, P13, and P14 and the threshold voltage compensation values TC for the second pixels P21, P22, P23, and P24, and calculate the limit offset values LO based on the first maximum difference value MD1. In an embodiment, each of the second difference values D2 may be a difference of the threshold voltage compensation values TC between the first pixels P11, P12, P13, and P14 and the second pixels P21, P22, P23, and P24 electrically connected to a same data line (i.e., when the first pixel is a P11, the second pixel is a P21). In an embodiment, each of the second difference values D2 may be absolute values of differences between the threshold voltage compensation values TC for the first-first pixel P11 and the second-first pixel P21, between the threshold voltage compensation values TC for the first-first pixel P11 and the second-first pixel P21 electrically connected to a same data line (e.g., DL1), between the threshold voltage compensation values TC for the first-second pixel P12 and the second-second pixel P22 electrically connected to a same data line (e.g., DL2), between the threshold voltage compensation values TC for the first-third pixel P13 and the second-third pixel P23 electrically connected to a same data line (e.g., DL3), and between the threshold voltage compensation values TC for the first-fourth pixel P14 and the second-fourth pixel P24 electrically connected to a same data line (e.g., DL4). In an embodiment, the driving controller 200 may calculate the limit offset values LO by calculating differences between the second difference values D2 and the first maximum difference value MD1. For example, the limit offset values LO may be the differences between the second difference values D2 and the first maximum difference value MD1. After the initial driving period, the driving controller 200 may determine the second pixel having the second difference value D2 greater than the first maximum difference value MD1 as erroneous compensation pixels MP. As mentioned above, when the difference of the data voltages VDATA between adjacent pixels (i.e., adjacent pixel rows) is less than the greatest value of the differences of the data voltages VDATA between adjacent pixels P (i.e., adjacent pixel rows) in the initial driving period (i.e., the first maximum difference value MD1), the mura phenomenon may not appear. Here, since the grayscale voltage is the same for all pixels P and the mura compensation is performed only in the initial driving period, the difference of the data voltages VDATA between adjacent pixels may be a difference of the threshold voltage compensation values TC. For example, when the second difference value D2 is greater than the first maximum difference value MD1, the mura phenomenon may appear because of the second pixels corresponding to the second difference value D2 greater than the first maximum difference value MD1. Accordingly, when the second difference value D2 is greater than the first maximum difference value MD1, the driving controller 200 may additionally compensate the input image data IMG for the second pixels corresponding to the second difference value D2 greater than the first maximum difference value MD1 based on the limit offset values LO.

For example, it is assumed that the threshold voltage compensation value TC of the first-first pixel P11 is 0.1, the threshold voltage compensation value TC of the first-second pixel P12 is 0.1, the threshold voltage compensation value TC of the first-third pixel P13 is 0.3, the threshold voltage compensation value TC of the first-fourth P14 is −0.1, the threshold voltage compensation value TC of the second-first pixel P21 is 0.4, the threshold voltage compensation value TC of the second-second pixel P22 is 0.3, the threshold voltage compensation value TC of the second-third pixel P23 is 0.4, and the threshold voltage compensation value TC of the second-fourth pixel P24 is 0.5, and the first maximum difference value MD1 is 0.2. In this case, the second difference value D2 of the second-first pixel P21 may be 0.3 (0.4−0.1=0.3), the second difference value D2 of the second-second pixel P22 may be 0.2 (0.3−0.1=0.2), the second difference value D2 of the second-third pixel P23 may be 0.1 (0.4−0.3=0.1), and the second difference value D2 of the second-fourth pixel P24 may be 0.6 (0.5−(−0.1)=0.6). Also, the limit offset value LO of the second-first pixel P21 may be 0.1 (0.3−0.2=0.1), the limit offset value LO of the second-second pixel P22 may be 0 (0.2−0.2=0), the limit offset value LO of the second-third pixel P23 may be −0.1 (0.1−0.2=−0.1), and the limit offset value LO of the second-fourth pixel P24 may be 0.4 (0.6−0.2=0.4). Accordingly, the second pixels corresponding to the second difference value D2 greater than the first maximum difference value MD1 (i.e., 0.2) are the second-first pixel P21 and the second-fourth pixel P24. Accordingly, the second-first pixel P21 and the second-fourth pixel P24 may be determined as the erroneous compensation pixels MP.

Referring to FIGS. 5, 6, 7, 8, and 9, the driving controller 200 may generate the threshold voltage compensation values TC of the second pixels P21, P22, P23, and P24 based on threshold voltages of the second pixels P21, P22, P23, and P24, and compensate the input image data for the second pixels P21, P22, P23, and P24 based on the threshold voltage compensation values TC and the limit offset values LO. After initial driving period, the driving controller 200 may determine the second pixels P21, P22, P23, and P24 corresponding to the second differences value D2 greater than the first maximum difference value MD1 as the erroneous compensation pixels MP, calculate the third difference values D3 by calculating differences between the threshold voltage compensation values TC for the erroneous compensation pixels MP and the limit offset values LO for the erroneous compensation pixels MP, and compensate the input image data for the erroneous compensation pixels MP based on the third difference values D3. In an embodiment, the driving controller 200 may compensate the input image data IMG so that the data voltages VDATA increases by the third difference values D3. For example, when the third difference value D3 is 0.3V and the grayscale voltage for displaying 255 grayscale level is 2V, the data voltage VDATA applied to a specific erroneous compensation pixel for displaying 255 grayscale level may be 2.3V. The driving controller 200 may compensate input image data for pixels other than the erroneous compensation pixels MP based on the threshold voltage compensation values TC. For example, when the threshold voltage compensation value TC of a specific pixel other than the erroneous compensation pixels MP is 0.3V and the grayscale voltage for displaying 255 grayscale level is 2V, the data voltage VDATA applied to the specific pixel other than the erroneous compensation pixels MP may be 2.3V.

For example, it is assumed that the grayscale voltage for displaying 255 grayscale level is 2V, the limit offset value LO of the second-first pixel P21 is 0.1, the limit offset value LO of the second-second pixel P22 is 0, the limit offset value LO of the second-third pixel P23 is −0.1, the limit offset value LO of the second-fourth pixel P24 is 0.4, the threshold voltage compensation value TC of the second-first pixel P21 is 0.4, the threshold voltage compensation value TC of the second-second pixel P22 is 0.3, the threshold voltage compensation value TC of the second-third pixel P23 is 0.4, the threshold voltage compensation value TC of the second-fourth pixel P24 is 0.5, the first maximum difference value MD1 is 0.2, and the second-first pixel P21 and the second-fourth pixel P24 are the erroneous compensation pixels MP. The third difference value D3 of the second-first pixel P21 may be 0.3 (0.4−0.1=0.3), and the third difference value D3 of the second-fourth pixel P24 may be 0.1 (0.5−0.4). Accordingly, the data voltage VDATA for displaying the 255 grayscale level of the second-first pixel P21 may be 2.3 (2+0.3=2.3), and the data voltage VDATA for displaying the 255 grayscale level of the second-fourth pixel P24 may be 2.1 (2+0.1=2.1). As a result, as shown in FIGS. 8 and 9, a difference between the data voltage VDATA (2+0.1) for displaying the 255 grayscale level of the first-first pixel P11 and the data voltage VDATA (2+0.3) for displaying the 255 grayscale level of the second-first pixel P21 may be equal to the first maximum difference value MD1 as 0.2. Also, as shown in FIGS. 8 and 9, a difference between the data voltage VDATA (2−0.1) for displaying the 255 grayscale level of the first-fourth pixel P14 pixel and the data voltage VDATA (2+0.1) for displaying the 255 grayscale level of the second-fourth pixel P24 may be equal to the first maximum difference value MD1 as 0.2. Input image data for pixels other than the erroneous compensation pixels MP (i.e., the second-second pixel P22 and the second-third pixel P23) may be compensated based on only the threshold voltage compensation value TC. Accordingly, the data voltage VDATA for displaying the 255 grayscale level of the second-second pixel P22 may be 2.3 (2+0.3), and the data voltage VDATA for displaying the 255 gray level of the second-third pixel P23 may be 2.4 (2+0.4). Accordingly, the display apparatus 1000 may remove the mura phenomenon displayed on an image after the initial driving period by preventing a differences of data voltages VDATA between adjacent pixel rows after the initial driving period from exceeding a maximum value of differences of data voltages VDATA between the adjacent pixel rows in the initial driving period.

FIGS. 10, 11, and 12 are tables for describing an example in which the display apparatus 1000 of FIG. 1 compensates the input image data IMG for the second pixels P21, P22, P23, and P24.

The display apparatus according to the this embodiment is substantially the same as the display apparatus 1000 of FIG. 1 except for compensating the input image data IMG after the initial driving period. Thus, the same reference numerals are used to refer to the same or similar element, and any repetitive explanation will be omitted.

Referring to FIGS. 6, 10, 11, and 12, in the initial driving period, the driving controller 200 may generate the first difference values D1 by calculating the differences between the data voltages VDATA for the first pixels P11, P12, P13, and P14 included in the N-th pixel row PR[N] and the data voltages VDATA for the second pixels P21, P22, P23, and P24 included in the (N+1)-th pixel row PR[N+1] among the pixels P. After the initial driving period, the driving controller 200 may calculate the limit offset value LO of the second pixels P21, P22, P23, and P24 based on the first difference values D1, an average threshold voltage compensation value ATC of the first pixels P11, P12, P13, and P14, and an average threshold voltage compensation value ATC of the second pixels P21, P22, P23, and P24, generate the threshold voltage compensation values TC of the second pixels P21, P22, P23, and P24 based on the threshold voltages of the second pixels P21, P22, P23, and P24, and compensate the input image data for the second pixels P21, P22, P23, and P24 based on the threshold voltage compensation values TC and the limit offset value LO. Since N is an arbitrary positive integer, the driving controller 200 may compensate the input image data for all the pixels P of the display panel 100.

In an embodiment for a first pixel row, in the initial driving period, the driving controller 200 may calculate differences of the data voltages VDATA between pixels included in the first pixel row and pixels included in a second pixel row to generate the first difference values D1. After the initial driving period, the driving controller 200 may calculate the limit offset value LO of the pixels included in the first pixel row based on the first difference values D1, the average threshold voltage compensation value ATC of the pixels included in the first pixel row, and the average threshold voltage compensation value ATC of the pixels included in the second pixel row for the first pixels row and the second pixel row, calculate the limit offset value LO of the pixels included in the first pixel row, generate the threshold voltage compensation values TC of the pixels included in the first pixel row are generated based on the threshold voltages of the pixels included in the first pixel row, and compensate the input image data for the pixels included in the first pixel row based on the threshold voltage compensation values TC and limit offset value LO.

Referring to FIGS. 5, 6, and 10, the driving controller 200 may generate the first difference values D1 by calculating the differences between the data voltages VDATA for the first pixels P11, P12, P13, and P14 included in the N-th pixel row PR[N] and the data voltages VDATA for the second pixels P21, P22, P23, and P24 included in the (N+1)-th pixel row PR[N+1] among the pixels P in the initial driving period. Each of the first difference values D1 may be a difference of the data voltages VDATA for displaying a same grayscale level between the first-first pixel P11 and the second-first pixel P21 electrically connected to a same data line (e.g., DL1), between the first-second pixel P12 and the second-second pixel P22 electrically connected to a same data line (e.g., DL2), between the first-third pixel P13 and the second-third pixel P23 electrically connected to a same data line (e.g., DL3), and between the first-fourth pixel P14 and the second-fourth pixel P24 electrically connected to a same data line (e.g., DL4). The driving controller 200 may determine the first maximum difference value MD1 among the first difference values D1. The first maximum difference value MD1 may be the greatest value among the first difference values D1. As mentioned above, the mura phenomenon may not appear in the image of the input image data IMG compensated based on the initial threshold voltage compensation values ITC and the mura compensation values MC. The mura phenomenon may be generated by a difference of luminance between adjacent pixels P. For example, when the differences of the data voltages VDATA between adjacent pixels (i.e., adjacent pixel rows) is less than the greatest value of the differences of the data voltages VDATA between adjacent pixels P (i.e., adjacent pixel rows) in the initial driving period (i.e., the first maximum difference value MD1), the mura phenomenon may not appear.

For example, it is assumed that the grayscale voltage for displaying 255 grayscale level is 2V, a sum of the initial threshold voltage compensation value ITC of the first-first pixel P11 and the mura compensation value MC of the first-first pixel P11 is 0, a sum of the initial threshold voltage compensation value ITC of the first-second pixel P12 and the mura compensation value MC of the first-second pixel P12 is 0, a sum of the initial threshold voltage compensation value ITC of the first-third pixel P13 and the mura compensation value MC of the first-third pixel P13 is −0.1, a sum of the initial threshold voltage compensation value ITC of the second-fourth pixel P24 and the mura compensation value MC of the first-fourth pixel P14 is 0, a sum of the initial threshold voltage compensation value ITC of the second-first pixel P21 and the mura compensation value MC of the second-first pixel P21 is 0, a sum of the initial threshold voltage compensation value ITC of the second-second pixel P22 and the mura compensation value MC of the second-second pixel P22 is 0.1, a sum of the initial threshold voltage compensation value ITC of the second-third pixel P23 and the mura compensation value MC of the second-third pixel P23 is 0.1, and a sum of the initial threshold voltage compensation value ITC of the second-fourth pixel P24 and the mura compensation value MC of the second-fourth pixel P24 is 0.1. In this case, the first difference values D1 may be 0 (2−2=0), 0.1 (2.1−2=0.1), 0.2 (2.1−1.9=0.2), and 0.1 (2.1−2=0.1). Since the greatest value among the first difference values D1 is 0.2, the first maximum difference value MD1 is 0.2.

Referring to FIGS. 5, 6, 10, and 11, the driving controller 200 may calculate the limit offset value LO of the second pixels P21, P22, P23, and P24 based on the first difference values D1, an average threshold voltage compensation value ATC of the first pixels P11, P12, P13, and P14, and an average threshold voltage compensation value ATC of the second pixels P21, P22, P23, and P24. The driving controller 200 may calculate the limit offset value LO based on the first maximum difference value MD1. The driving controller may generate fourth difference value D4 by calculating a difference between the average threshold voltage compensation value ATC of the first pixels P11, P12, P13, and P14 and the average threshold voltage compensation value ATC of the second pixels P21, P22, P23, and P24, and calculate the limit offset value LO based on the fourth difference value D4 and the first maximum difference value MD1. In an embodiment, the fourth difference value D4 may be a difference of the average threshold voltage compensation values ATC between the first-first pixel P11 and the second-first pixel P21 electrically connected to a same data line (e.g., DL1), between the first-second pixel P12 and the second-second pixel P22 electrically connected to a same data line (e.g., DL2), between the first-third pixel P13 and the second-third pixel P23 electrically connected to a same data line (e.g., DL3), and between the first-fourth pixel P14 and the second-fourth pixel P24 electrically connected to a same data line (e.g., DL4). In an embodiment, the driving controller 200 may calculate the limit offset value LO by calculating a difference between the fourth difference value D4 and the first maximum difference value MD1. For example, the limit offset value LO may be the difference between the fourth difference value D4 and the first maximum difference value MD1. After the initial driving period, when the fourth difference value D4 is greater than the first maximum difference value MD1, the driving controller 200 may determine the second pixels P21, P22, P23, and P24 as the erroneous compensation pixels MP. As mentioned above, when the differences of the data voltages VDATA between adjacent pixels (i.e., adjacent pixel rows) is less than the greatest value of the differences of the data voltages VDATA between adjacent pixels P (i.e., adjacent pixel rows) in the initial driving period (i.e., the first maximum difference value MD1), the mura phenomenon may not appear. Here, since the grayscale voltage is the same for all pixels P and the mura compensation is performed only in the initial driving period, the difference of the data voltages VDATA between adjacent pixels may be a difference of the threshold voltage compensation values TC. For example, when the fourth difference value D4 is greater than the first maximum difference value MD1, the mura phenomenon may appear because of the second pixels P21, P22, P23, and P24. Accordingly, when the fourth difference value D4 is greater than the first maximum difference value MD1, the driving controller 200 may additionally compensate the input image data IMG for the second pixels P21, P22, P23, and P24 based on the limit offset value LO.

For example, it is assumed that the threshold voltage compensation value TC of the first-first pixel P11 is 0.1, the threshold voltage compensation value TC of the First-second pixel P12 is 0.1, the threshold voltage compensation value TC of the first-third pixel P13 is 0.3, the threshold voltage compensation value TC of the P14 pixel is −0.1, the threshold voltage compensation value TC of the second-first pixel P21 is 0.4, the threshold voltage compensation value TC of the second-second pixel P22 is 0.3, the threshold voltage compensation value TC of the second-third pixel P23 is 0.4, and the threshold voltage compensation value TC of the second-fourth pixel P24 is 0.5, and the first maximum difference value MD1 is 0.2. In this case, the average threshold voltage compensation value ATC of the first pixels P11, P12, P13, and P14 may be 0.1, the average threshold voltage compensation value ATC of the second pixels P21, P22, P23, and P24 may be 0.4, and the fourth difference value D4 may be 0.3 (0.4−0.1=0.3). Accordingly, since the fourth difference value D4 (i.e., 0.3) is greater than the first maximum difference value MD1 (i.e., 0.2), the driving controller 200 may determine the second pixels P21, P22, P23, and P24 as the erroneous compensation pixels MP.

Referring to FIGS. 5, 6, 10, 11, and 12, after the initial driving period, the driving controller 200 may generate the threshold voltage compensation values TC of the second pixels P21, P22, P23, and P24 based on the threshold voltages of the second pixels P21, P22, P23, and P24, and compensate the input image data for the second pixels P21, P22, P23, and P24 based on the threshold voltage compensation values TC and the limit offset value LO. After the initial driving period, when the fourth difference value D4 is greater than the first maximum difference value MD1, the driving controller 200 may determine the second pixels P21, P22, P23, and P24 as the erroneous compensation pixels MP, calculate fifth difference values D5 by calculating differences between the threshold voltage compensation values TC of each of the erroneous compensation pixels MP and the limit offset value LO, and compensate the input image data for the erroneous compensation pixels MP based on the fifth difference values D5. In an embodiment, the driving controller 200 may compensate the input image data IMG so that the data voltages VDATA increases by the fifth difference values D5. For example, when the fifth difference value D5 is 0.3V and the grayscale voltage for displaying 255 grayscale level is 2V, the data voltage VDATA applied to a specific erroneous compensation pixel to display 255 grayscale level may be 2.3V. The driving controller 200 may compensate input image data for pixels other than the erroneous compensation pixels MP based on the threshold voltage compensation values TC. For example, when the threshold voltage compensation value TC of a specific pixel other than the erroneous compensation pixels MP is 0.3V and the grayscale voltage for displaying 255 grayscale level is 2V, the data voltage VDATA applied to the specific pixel other than the erroneous compensation pixels MP may be 2.3V.

For example, it is assumed that the grayscale voltage for displaying 255 grayscale level is 2V, the limit offset value LO of the second pixels P21, P22, P23, and P24 is 0.1, the threshold voltage compensation value TC of the second-first pixel P21 is 0.4, the threshold voltage compensation value TC of the second-second pixel P22 is 0.3, the threshold voltage compensation value TC of the second-third pixel P23 is 0.4, the threshold voltage compensation value TC of the second-fourth pixel P24 is 0.5, the first maximum difference value MD1 is 0.2, and the second pixels P21, P22, P23, and P24 are the erroneous compensation pixels MP. The fifth difference value D5 of the second-first pixel P21 may be 0.3 (0.4−0.1=0.3), the fifth difference value D5 of the second-second pixel P22 may be 0.2 (0.3−0.1=0.2), the fifth difference value D5 of the second-third pixel P23 may be 0.3 (0.4−0.1=0.3), and the fifth difference value D5 of the second-fourth pixel P24 may be 0.4 (0.5−0.1=0.4). Accordingly, the data voltage VDATA for displaying the 255 grayscale level of the second-first pixel P21 may be 2.3 (2+0.3=2.3), the data voltage VDATA for displaying the 255 grayscale level of the second-second pixel P22 may be 2.2 (2+0.2=2.2), the data voltage VDATA for displaying the 255 grayscale level of the second-third pixel P23 may be 2.3 (2+0.3=2.3), and the data voltage VDATA for displaying the 255 grayscale level of the second-fourth pixel P24 may be 2.4 (2+0.4=2.4). As a result, as shown in FIGS. 11 and 12, a difference between an average of the data voltages VDATA for displaying the 255 grayscale level of the first pixels P11, P12, P13, and P14 and an average of the data voltages VDATA for displaying the 255 grayscale level of the second pixel P21, P22, P23, and P24 may be equal to the first maximum difference value MD1. Accordingly, the display apparatus 1000 may remove the mura phenomenon displayed on an image after the initial driving period by preventing an average of differences of data voltages VDATA between adjacent pixel rows after the initial driving period from exceeding a maximum value of differences of data voltages VDATA between the adjacent pixel rows in the initial driving period.

The principles of the invention may be applied to various embodiments, including any electronic apparatus including the display apparatus. For example, embodiments of the invention may be applied to a television (TV), a digital TV, a 3D TV, a mobile phone, a smart phone, a tablet computer, a virtual reality (VR) apparatus, a wearable electronic apparatus, a personal computer (PC), a home appliance, a laptop computer, a personal digital assistant (PDA), a portable multimedia player (PMP), a digital camera, a music player, a portable game console, a navigation apparatus, etc.

Although certain embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display apparatus comprising:

a display panel including a plurality of pixels;

a data driver to provide data voltages to the plurality of pixels and to sense threshold voltages of the pixels; and a driving controller to generate first difference values by calculating differences between the data voltages for first pixels included in an N-th pixel row and the data voltages for second pixels included in an (N+1)-th pixel row among the plurality of pixels in an initial driving period, to calculate limit offset values for the second pixels based on the first difference values, to generate threshold voltage compensation values for the second pixels based on the threshold voltages of the second pixels, and to compensate input image data for the second pixels based on the threshold voltage compensation values and the limit offset values, where N is an integer greater than 0.

2. The display apparatus of claim 1, wherein each of the first difference values is a difference of the data voltages for displaying a same grayscale level between a corresponding one of the first pixels and a corresponding one of the second pixels electrically connected to a same data line.

3. The display apparatus of claim 1, wherein, in the initial driving period, the driving controller is configured to generate mura compensation values of the plurality of pixels and to compensate the input image data based on the mura compensation values and the threshold voltage compensation values.

4. The display apparatus of claim 3, wherein, in the initial driving period, the driving controller is configured to capture an image displayed on the display panel and to generate the mura compensation values based on the captured image.

5. The display apparatus of claim 3, wherein the driving controller is configured to determine a first maximum difference value among the first difference values, and to calculate the limit offset values based on the first maximum difference value.

6. The display apparatus of claim 5, wherein the driving controller is configured to generate second difference values by calculating differences between the threshold voltage compensation values for the first pixels and the threshold voltage compensation values for the second pixels, and to calculate the limit offset values based on the second difference values and the first maximum difference value.

7. The display apparatus of claim 6, wherein each of the second difference values is a difference of the threshold voltage compensation values between a corresponding one of the first pixels and a corresponding one of the second pixels electrically connected to a same data line.

8. The display apparatus of claim 6, wherein the driving controller is configured to calculate the limit offset values by calculating differences between the second difference values and the first maximum difference value.

9. The display apparatus of claim 8, wherein the driving controller is configured to identify the second pixels corresponding to the second difference values greater than the first maximum difference value as erroneous compensation pixels, to calculate third difference values by calculating differences between the threshold voltage compensation values of the erroneous compensation pixels and the limit offset values of the erroneous compensation pixels, and to compensate the input image data for the erroneous compensation pixels based on the third difference values.

10. The display apparatus of claim 1, wherein the data driver is configured to sense the threshold voltages of the pixels in a power-off period.

11. The display apparatus of claim 1, wherein each of the pixels comprises:

a first switching element including a control electrode electrically connected to a first node, an input electrode to receive a first power voltage, and an output electrode electrically connected to a second node;

a second switching element including a control electrode to receive a first signal, an input electrode to receive a corresponding data voltage, and an output electrode electrically connected to the first node;

a light emitting element including a first electrode electrically connected to the second node and a second electrode electrically to receive a second power voltage; and a third switching element including a control electrode to receive a second signal, an input electrode electrically connected to the second node, and an output electrode electrically connected to a third node.

12. A display apparatus comprising:

a display panel including a plurality of pixels;

a data driver to provide data voltages to the plurality of pixels and to sense threshold voltages of the plurality of pixels; and a driving controller to generate first difference values by calculating differences between the data voltages for first pixels included in an N-th pixel row and second pixels included in an (N+1)-th pixel row among the plurality of pixels in an initial driving period, to calculate a limit offset value for the second pixels based on the first difference values, an average threshold voltage compensation value for the first pixels, and an average threshold voltage compensation value for the second pixels, to generate threshold voltage compensation values for the second pixels based on the threshold voltages of the second pixels, and to compensate input image data for the second pixels based on the threshold voltage compensation values and the limit offset value, where N is an integer greater than 0.

13. The display apparatus of claim 12, wherein each of the first difference values is a difference of the data voltages for displaying a same grayscale level between a corresponding one of the first pixels and a corresponding one of the second pixels electrically connected to a same data line.

14. The display apparatus of claim 12, wherein in the initial driving period, the driving controller is configured to generate mura compensation values of the plurality of pixels and to compensate the input image data based on the mura compensation values and the threshold voltage compensation values.

15. The display apparatus of claim 14, wherein, in the initial driving period, the driving controller is configured to capture an image displayed on the display panel and to generate the mura compensation values based on the captured image.

16. The display apparatus of claim 14, wherein the driving controller is configured to determine a first maximum difference value among the first difference values, and to calculate the limit offset value based on the first maximum difference value.

17. The display apparatus of claim 16, wherein the driving controller is configured to generate fourth difference value by calculating a difference between the average threshold voltage compensation value for the first pixels and the average threshold voltage compensation value for the second pixels, and to calculate the limit offset value based on the fourth difference value and the first maximum difference value.

18. The display apparatus of claim 17, wherein the driving controller is configured to calculate the limit offset value by calculating a difference between the fourth difference value and the first maximum difference value.

19. The display apparatus of claim 18, wherein the driving controller is configured to identify the second pixels as erroneous compensation pixels when the fourth difference value is greater than the first maximum difference value, to calculate fifth difference values by calculating differences between the threshold voltage compensation values for the erroneous compensation pixels and the limit offset value, and to compensate the input image data for the erroneous compensation pixels based on the fifth difference values.

20. The display apparatus of claim 12, wherein the data driver is configured to sense the threshold voltages in a power-off period.

21. A method of driving a plurality of pixels in a display apparatus, the method comprising:

generating data voltages to sense threshold voltages of the pixels;

generating first difference values by calculating differences between the data voltages for first pixels included in an N-th pixel row and the data voltages for second pixels included in an (N+1)-th pixel row among the plurality of pixels in an initial driving period;

calculating limit offset values for the second pixels based on the first difference values;

generating threshold voltage compensation values for the second pixels based on the threshold voltages of the second pixels; and compensating input image data for the second pixels based on the threshold voltage compensation values and the limit offset values, where N is an integer greater than 0.

22. The method of claim 21, further comprising:

generating mura compensation values of the plurality of pixels; and compensating the input image data based on the mura compensation values and the threshold voltage compensation values.

23. The method of claim 22, further comprising:

capturing an image displayed by the pixels in the initial driving period, and generating the mura compensation values based on the captured image.

* * * * *